US006342876B1

(12) United States Patent
Kim

(10) Patent No.: US 6,342,876 B1
(45) Date of Patent: Jan. 29, 2002

(54) METHOD AND APPARATUS FOR DRIVING LIQUID CRYSTAL PANEL IN CYCLE INVERSION

(75) Inventor: Han Seop Kim, Kumi (KR)

(73) Assignee: LG. Phillips LCD Co., LTD, Seoul (KR)

( * ) Notice: Subject to any disclaimer, the term of this patent is extended or adjusted under 35 U.S.C. 154(b) by 0 days.

(21) Appl. No.: 09/299,531

(22) Filed: Apr. 26, 1999

(30) Foreign Application Priority Data

Oct. 21, 1998 (KR) ..... 98-44179

(51) Int. Cl.[7] ..... G09G 3/36
(52) U.S. Cl. ..... 345/87; 345/96; 345/213
(58) Field of Search ..... 345/87, 96, 209

(56) References Cited

U.S. PATENT DOCUMENTS 4,757,264 A * 7/1988 Lee et al. ..... 328/63
5,648,793 A * 7/1997 Chen ..... 345/96
5,790,092 A * 8/1998 Moriyama ..... 345/96
5,946,068 A * 8/1999 Lee et al. ..... 349/143
6,172,662 B1 * 1/2001 Ito et al. ..... 345/94

* cited by examiner

*Primary Examiner*—Richard Hjerpe
*Assistant Examiner*—Kim Nhung Nguyen
(74) *Attorney, Agent, or Firm*—Long Aldridge & Norman, LLP

(57) ABSTRACT

A liquid crystal panel driving method and apparatus of cycle inversion system is adapted to stably keep a picture quality independently of a pattern of picture and improves a picture quality. In the apparatus, liquid crystal cells in the liquid crystal panel are divided into a number of polarity blocks. The same polarities of data signals are applied to the liquid crystal cells included in each polarity block, data signals having polarities different from the adjacent polarity blocks to each polarity block. The number of liquid crystal cells included in each of the number of polarity blocks are gradually increased every predetermined number of frame period.

25 Claims, 11 Drawing Sheets

Fig. 2A
PRIOR ART

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

Fig. 2B
PRIOR ART

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

Fig. 3A
PRIOR ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

Fig. 3B
PRIOR ART

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

Fig. 4A
PRIOR ART

| | | | | | | | |
|---|---|---|---|---|---|---|---|
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |

Fig. 4B
PRIOR ART

| | | | | | | | |
|---|---|---|---|---|---|---|---|
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |

Fig. 9A

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

Fig. 9B

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

Fig. 9C

| | | | | | | | |
|---|---|---|---|---|---|---|---|
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |

Fig. 9D

| | | | | | | | |
|---|---|---|---|---|---|---|---|
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |

Fig. 9E

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| − | + | − | + | − | + | − | + |
| − | + | − | + | − | + | − | + |
| − | + | − | + | − | + | − | + |
| − | + | − | + | − | + | − | + |

Fig. 9F

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| + | − | + | − | + | − | + | − |
| + | − | + | − | + | − | + | − |
| + | − | + | − | + | − | + | − |
| + | − | + | − | + | − | + | − |

METHOD AND APPARATUS FOR DRIVING LIQUID CRYSTAL PANEL IN CYCLE INVERSION

This application claims the benefit of Korean Patent Application No. p98-44179, filed on Oct. 21, 1998, which is hereby incorporated by reference.

BACKGROUND OF THE INVENTION

1. Field of the Invention

This invention relates to an apparatus and a technique for driving a liquid crystal panel in a liquid crystal display device, and more particularly to a driving method of driving a liquid crystal panel in an inversion system and an apparatus thereof.

2. Description of the Prior Art

Generally, a liquid crystal display device controls the light transmissivity of liquid crystal cells in a liquid crystal panel to display a picture corresponding to a video signal. Such a liquid crystal display device uses generally four driving methods, such as line inversion system, column inversion system, dot inversion system and group inversion system, so as to drive the liquid crystal cells in the liquid crystal panel.

In a liquid crystal panel driving method of line inversion system, as shown in FIG. 1A and FIG. 1B, polarities of data signals applied to the liquid crystal panel are inverted in accordance with row lines, e.g., gate lines, on the liquid crystal panel in each frame. In a liquid crystal panel driving method of column inversion system, as shown in FIG. 2A and FIG. 2B, polarities of data signals applied to the liquid crystal panel are inverted in accordance with column lines, e.g., source lines, on the liquid crystal panel in each frame. A cross talk in a vertical direction seriously emerges in a picture displayed on the liquid crystal panel by means of the liquid crystal panel driving method of column inversion system. In other words, the liquid crystal panel driving method of column inversion allows a serious flicker to emerge between vertical lines.

In a liquid crystal panel driving method of dot inversion system, as shown in FIG. 3A and FIG. 3B, data signals having polarities contrary to the adjacent liquid crystal cells on the gate lines and to the adjacent liquid crystal cells on the data lines are applied to each liquid crystal cell in the liquid crystal panel, and the polarities of data signals applied to all liquid crystal cells in the liquid crystal panel are inverted every frame. In other words, in the dot inversion system, data signals are applied to the liquid crystal cells in the liquid crystal panel in such a manner that the positive (+) polarity and the negative (−) polarity appear alternately as shown in FIG. 3A as it goes from the liquid crystal cell at the left upper end into the liquid crystal cells at the right side and into the liquid crystal cells at the lower side when a video signal in the odd numbered frame is displayed; while data signals are applied to the liquid crystal cells in the liquid crystal panel in such a manner that the positive (+) polarity and the negative (−) polarity appear alternately as shown in FIG. 3B as it goes from the liquid crystal cell at the left upper end into the liquid crystal cells at the right side and into the liquid crystal cells at the lower side when a video signal in the even-numbered frame is displayed.

Finally, in a liquid crystal panel driving method of group inversion system, assuming that liquid crystal cells in the liquid crystal panel are divided into liquid crystal groups having a certain number (e.g., 2) of liquid crystal cells each, as shown in FIG. 4A and FIG. 4B, data signals having polarities contrary to the adjacent liquid crystal cell groups on the gate lines and to the adjacent liquid crystal cell groups on the data lines are applied to each liquid crystal group. Also, the liquid crystal panel driving method of group inversion system allows the polarities of data signals applied to all liquid crystal cells in the liquid crystal panel to be inverted every frame.

A picture displayed on the liquid crystal panel according to the liquid crystal panel driving method of line inversion system in these liquid crystal panel driving methods has a serious cross talk in the vertical direction. Particularly, when a picture alternates between two colors, for example, a color with a medium gray scale and a black color, and is displayed on the liquid crystal panel by the liquid crystal panel driving method of line inversion system as shown in FIG. 5, a serious flicker emerges between the horizontal lines depending on the line.

On the other hand, a picture displayed on the liquid crystal panel according to the liquid crystal panel driving method of column inversion system has a serious cross talk in the horizontal direction. Further, when a picture alternates between two colors, for example, a color with a medium gray scale and a black color, depending on the column lines by the liquid crystal panel driving method of line inversion system is displayed on the liquid crystal panel, a serious flicker emerges between the horizontal lines. On the other hand, the liquid crystal panel driving methods of dot and group inversion system having the polarities of data signals inverted in both the vertical and horizontal direction provide more excellent quality of pictures compared with the line and column inversion systems. Owing to this advantage, the liquid crystal panel driving methods of dot and group inversion system have been widely used in the industry.

However, the liquid crystal panel driving methods of dot and group inversion system reveal a frame inversion effect when a specific pattern, such as check pattern, subpixel pattern and windows shut-down mode pattern, etc., is displayed. Due to this, a flicker is generated and, further, the picture quality deteriorates in a picture displayed by the liquid crystal panel driving methods of dot and group inversion system. More specifically, only liquid crystal cells indicated with oblique lines and liquid crystal cells indicated with oblique lines when a potential difference between data signals applied to the remaining cells is large in liquid crystal cells on the liquid crystal panel shown in FIG. 7 and FIG. 8 are assumed to be driven in a pattern having the polarities inverted every frame. In other words, only liquid crystal cells indicated with the oblique lines in FIG. 7 and FIG. 8 seem to be driven with the frame inversion system. Due to this, in the liquid crystal panel driving methods of dot and group inversion system, a flicker noise emerges on the screen is dictated by a picture pattern. As a result, picture quality displayed by the liquid crystal panel driving methods of dot and group inversion system is inconsistent.

SUMMARY OF THE INVENTION

Accordingly, it is an object of the present invention to provide a liquid crystal panel driving method and apparatus that is adaptive for keeping the picture quality independently of a picture pattern as well as improving the picture quality.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In order to achieve these and other objects of the invention, a liquid crystal panel driving apparatus comprises a liquid crystal panel having liquid crystal cells arranged in a substantially matrix form; drivers arranged adjacent the liquid crystal cells to drive each one of the liquid crystal cells; a frequency controller responsive to a first input signal and a first clock signal to output at least two polarity control signals; and a multiplexor connected to the frequency controller to selectively output one of at least two polarity control signals to the drivers to control polarity of liquid crystal cells.

According to one aspect of the present invention, the frequency controller includes a first frequency divider responsive to a first input signal and a first clock signal to provide a first output; a second frequency divider responsive to the first output and the first clock signal to provide a second output; and a third frequency divider responsive to the second output and the first clock signal to provide a third output. The first, second and third outputs are frequency divided signal of the first input signal. The frequency controller further includes a counter responsive to a first clock signal to output a count signal to control the multiplexor. In the preferred embodiment of the present invention, the multiplexor is responsive to the count signal from the counter to output one of the at least two polarity signals to the drivers. In particular, the multiplexor is responsive to the count signal from the counter to output one of the first, second and third outputs from the first, second and third frequency dividers, respectively, to the drivers.

According to another aspect of the present invention, the first, second and third frequency dividers are flip-flops. In addition, the counter is preferably of a modulo 4 type. In the present invention, the first input signal is a horizontal sync signal and the first clock signal is a vertical sync signal.

According to the present invention, a method of driving a liquid crystal panel having liquid crystal cells comprises the steps of (a) grouping the liquid crystal cells in the liquid crystal panel into a plurality of polarity blocks, each polarity block having an initial number of liquid crystal cell; (b) applying data signals having a first polarity to liquid crystal cells in a first polarity block during a first frame; (c) applying data signals having a second polarity to liquid crystal cells in a second polarity block located adjacent the first polarity block during a second frame; and (d) incrementing a number of liquid crystal cells in the first and second polarity blocks by at least one liquid crystal cell. The steps of (b) to (d) are repeated in subsequent frames.

According to one aspect of the present invention, the liquid crystal cells of the first and second polarity blocks are arranged in a first direction of the liquid crystal panel. In particular, the first direction constitutes a vertical direction of the liquid crystal panel.

After repeating the steps of (b) to (d) for at least three times, the number of liquid crystal cells in the first and second polarity blocks are reset to the initial number of liquid crystal cell.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

FIGS. 2A and 2B illustrate polarity patterns of data signals applied to liquid crystal cells in the liquid crystal panel using a column inversion method;

FIGS. 3A and 3B illustrate polarity patterns of data signals applied to liquid Crystal cells in the liquid crystal panel using a dot inversion method;

FIGS. 4A and 4B illustrate polarity patterns of data signals applied to liquid crystal cells in the liquid crystal panel using a group inversion method;

FIGS. 9A to 9F illustrate polarity patterns of data signals applied to liquid crystal cells in the liquid crystal panel by a liquid crystal panel driving method of cycle inversion system according to an embodiment of the present invention;

DETAILED DESCRIPTION OF THE PREFERRED EMBODIMENTS

Figure 1A:
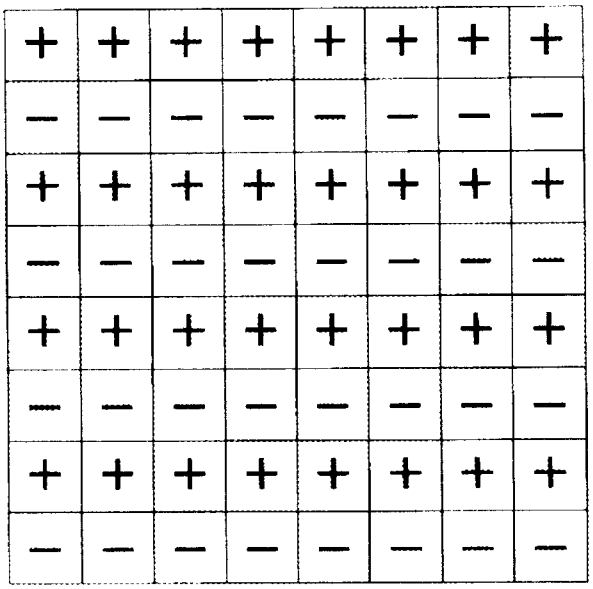
Fig. 1A PRIOR ART
FIGS. 1A and 1B illustrate polarity patterns of data signals applied to liquid crystal cells in the liquid crystal panel using a line inversion method.
Figure 1B:
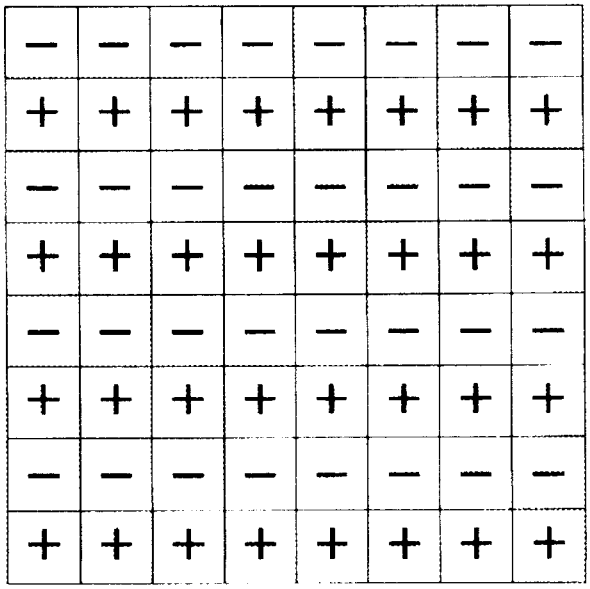
Fig. 1B PRIOR ART
Figure 5:
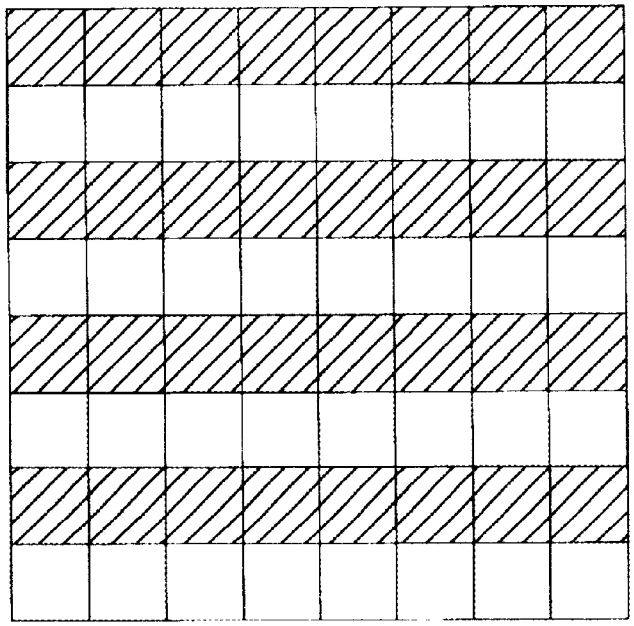
Fig. 5 PRIOR ART
FIG. 5 is a view for explaining a flicker generation phenomenon in a liquid crystal driving method of line inversion system.
Figure 6:
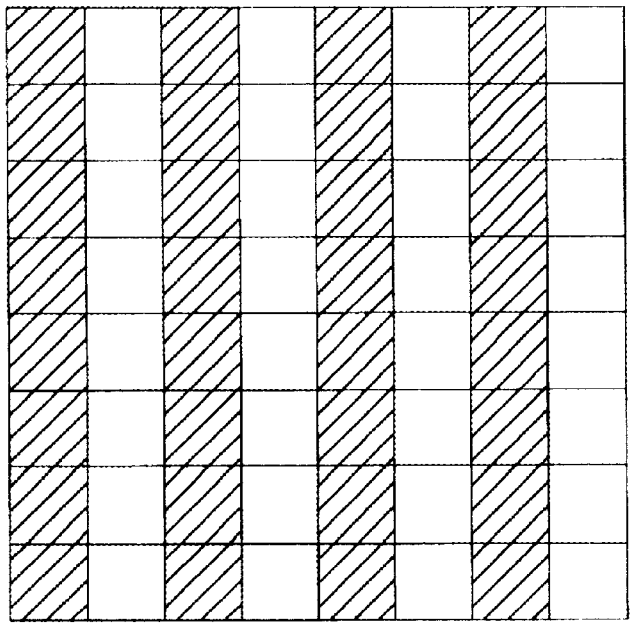
FIG. 6 is a view for explaining a flicker generation phenomenon in a liquid crystal driving method of column inversion system.
Figure 7:
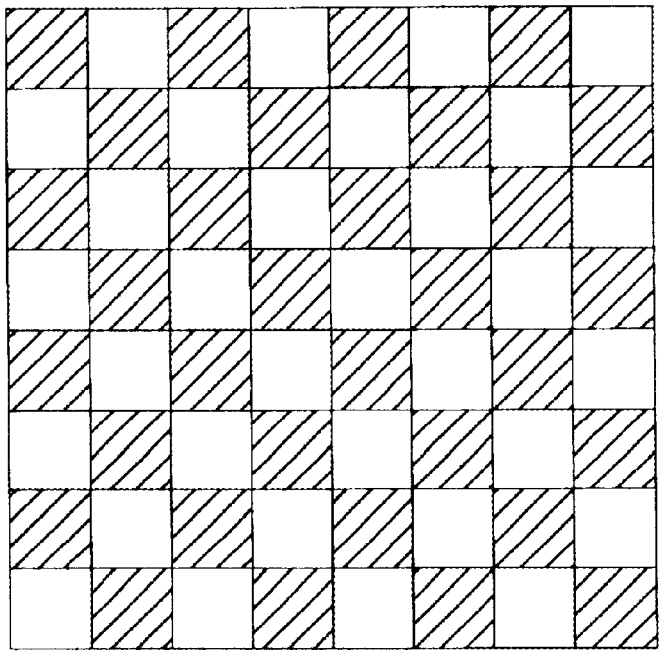
FIG. 7 is a view for explaining a flicker generation phenomenon in a liquid crystal driving method of dot inversion system.
Figure 8:
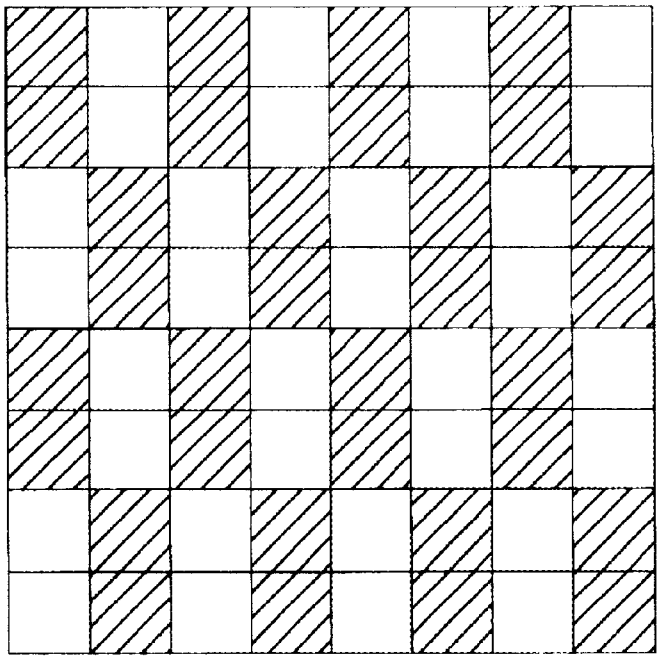
FIG. 8 is a view for explaining a flicker generation phenomenon in a liquid crystal driving method of group inversion system.

FIG. 9A to FIG. 9F illustrate a liquid crystal panel driving method according to an embodiment of the present invention. In FIG. 9A and FIG. 9B, there are illustrated polarities of data signals applied to liquid crystal cells in a liquid crystal panel during first and second frame intervals, respectively. During the first frame interval, as shown in FIG. 9A, data signals are applied to the liquid crystal cells in the liquid crystal panel in such a manner that the positive (+) polarity and the negative (−) polarity appear alternately proceeding from a liquid crystal cell in the left upper end into liquid crystal cells in the right side and into liquid crystal cells in the lower side. When a video signal in the second frame is displayed, as shown in FIG. 9B, data signals are applied to the liquid crystal cells in the liquid crystal panel in such a manner that the positive (+) polarity and the negative (−) polarity appear alternately as going from a liquid crystal cell in the left upper end into liquid crystal cells in the right side and into liquid crystal cells in the lower side.

FIG. 9C to FIG. 9F illustrate polarities of video signals applied to the liquid crystal cells in the liquid crystal panel during third to sixth frame intervals, respectively. Referring to FIG. 9C to FIG. 9F, video signals are applied to the liquid crystal panel in such a manner that the liquid crystal cells in the liquid crystal panel are divided into a number of groups and the polarity is inverted for each group. More specifically, in FIG. 9C and FIG. 9D, the liquid crystal panel is divided into a number of polarity blocks, each having two liquid crystal cells adjacent in the column lines, and a video signal having a polarity contrary to the adjacent polarity blocks in the vertical and horizontal direction is applied to each polarity block. The polarity of video signals applied to each liquid crystal cell in the liquid crystal panel during the third frame interval is opposite to that of video signals applied to each liquid crystal cell in the liquid crystal panel during the fourth frame interval.

In FIG. 9E and FIG. 9F, the liquid crystal panel is divided into a number of polarity blocks, each one of which has four liquid crystal cells adjacent in the column lines, and a video signal having a polarity contrary to the adjacent polarity blocks in the vertical and horizontal direction is applied to each polarity block. The polarity of video signals applied to each liquid crystal cell in the liquid crystal panel during the fifth frame interval is opposite to that of video signals applied to each liquid crystal cell in the liquid crystal panel during the sixth frame interval.

Each time two frame video signals are displayed on the liquid crystal panel, the number of liquid crystal cells adjacent in the column direction receive the same polarity of video signals applied to liquid crystal cells adjacent in the column line. The number of liquid crystal cells adjacent in the column direction receiving the same polarity of video signals is repeated in a certain number of frame period. For example, in FIGS. 9A–9F, there are six frames in which the liquid crystal cells are gradually increased in each polarity block. As described above, the number of liquid crystal cells included in the polarity block increases in accordance with the frame number in every predetermined number of frame period. The polarity of data signals is inverted every polarity block and every frame, so that a frame inversion drive effect does not appear and a cross talk in the horizontal and vertical direction is restrained in the liquid crystal panel driving method according to the present invention. Accordingly, in the liquid crystal panel driving method according to an embodiment of the present invention, a flicker noise is almost not generated even when a specific pattern, such as check pattern, subpixel pattern and windows shut-down mode pattern, etc., is displayed. Furthermore, picture quality is stably maintained independently of the picture pattern.

Figure 10:
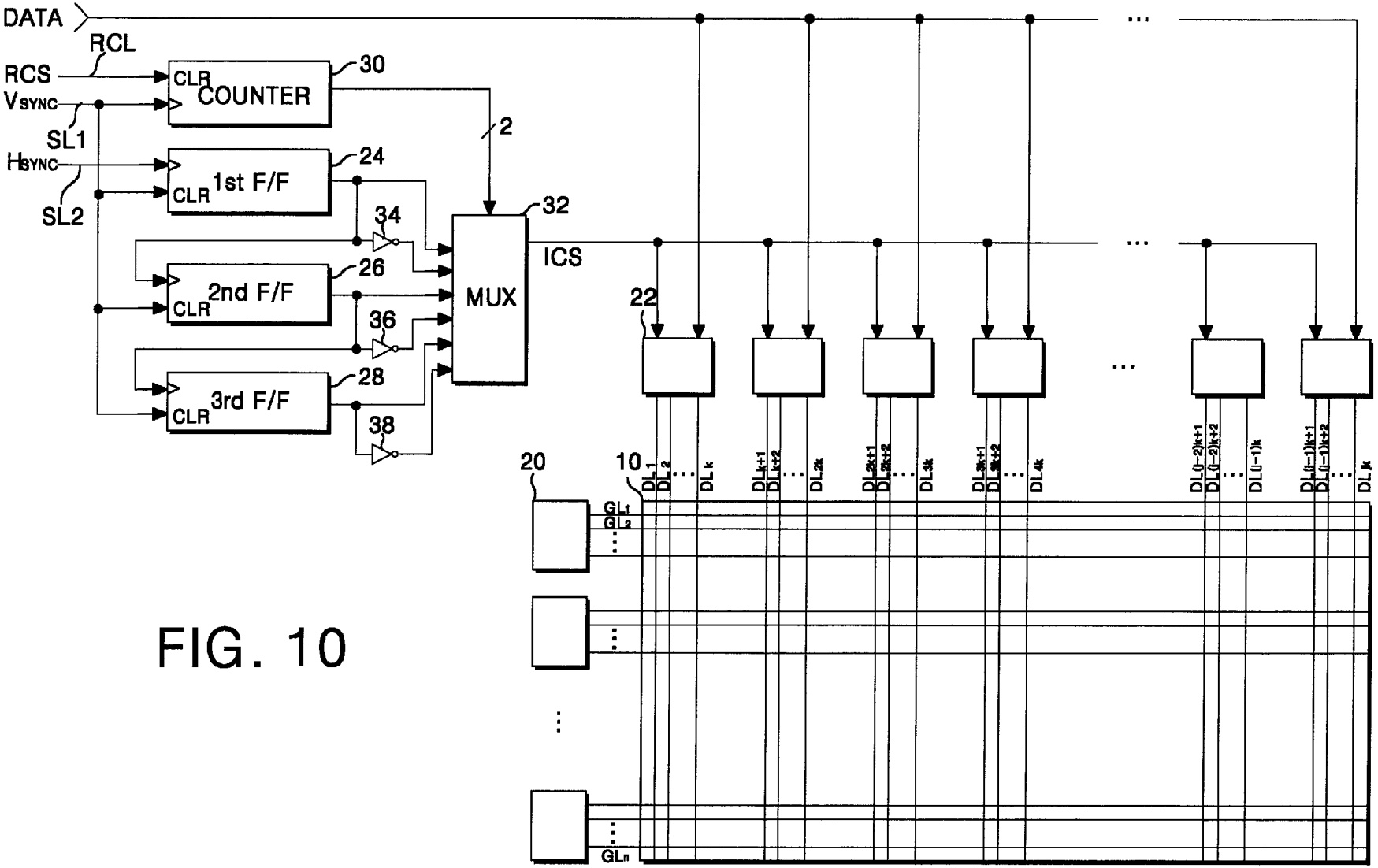
FIG. 10 is a schematic block diagram showing the configuration of a liquid crystal panel driving apparatus of cycle inversion system according to an embodiment of the present invention.

Referring now to FIG. 10, there is shown a liquid crystal panel driving apparatus according to an embodiment of the present invention. The liquid crystal panel driving apparatus includes gate driving integrated circuits (ICs) 20 for divisionally driving n gate lines GL1 to GLn on a liquid crystal panel 10, and j data driving ICs 22 for divisionally driving m data lines DL1 to DLm on the liquid crystal panel 10 by the k number. The liquid crystal panel 10 is provided with a number of liquid crystal cells and thin film transistors(TFTs) for switching data signals applied to each liquid crystal cell. The number of liquid crystal cells is installed at the intersections in which the data lines DL1 to DLm cross the gate lines GL1 to GLn, and the TFTs also are positioned at the intersections. The gate driving ICs 20 apply a gate drive pulse to n gate lines GL1 to GLn on the liquid crystal panel 10 sequentially to drive the n gate lines GL1 to GLn sequentially. Then, the TFTs in the liquid crystal panel 10 are sequentially driven for one gate line to apply data signals to liquid crystal cells for one gate line sequentially. Each of the j data driving ICs 22 applies k data signals to the k data lines DL1 to DLk whenever the gate drive pulse is generated. The k data signals generated at each data driving IC 22 have alternating polarities in accordance with an arrangement sequence of the adjacent data lines. Also, the k data signals generated at each data driving IC 22 have polarities changing alternately as the frame is progressed.

Figure 11:
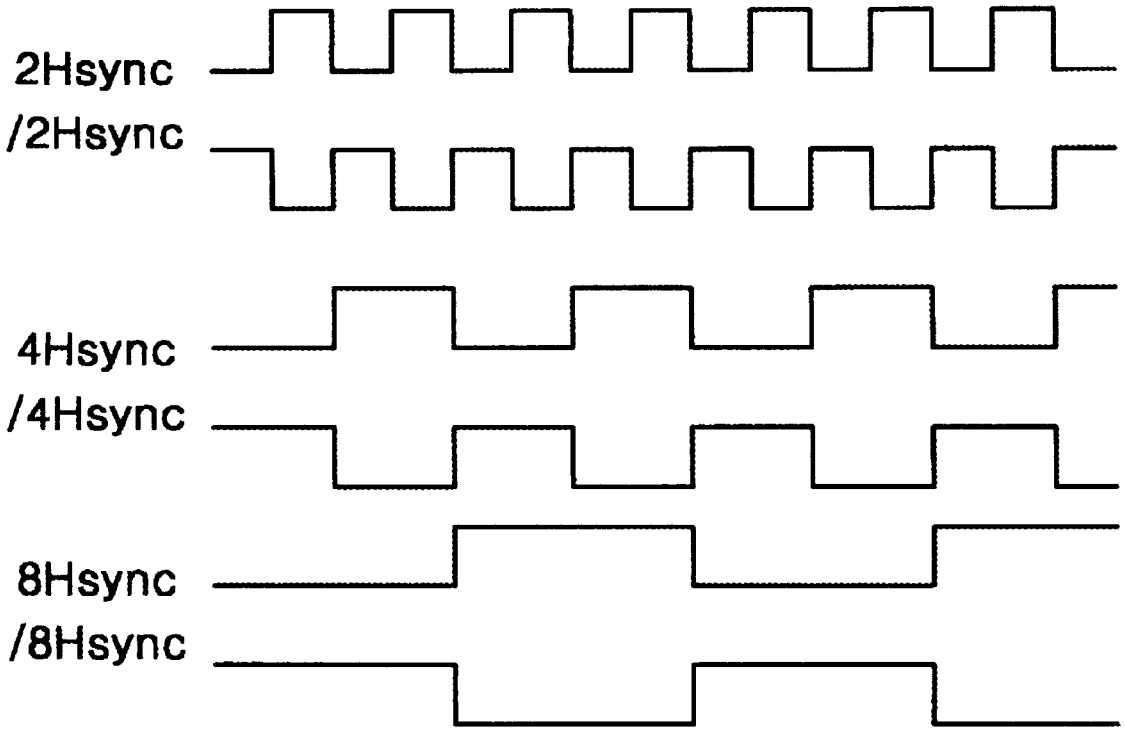
FIG. 11 is waveform diagrams of signals generated at each part of the liquid crystal panel driving apparatus shown in FIG. 10.

The liquid crystal driving apparatus further includes first to third flip-flop 24 to 28 and a counter for commonly receiving a vertical synchronizing signal Vsync from a first synchronous line SL1. The first to third flip-flops 24 to 28 are connected to a second synchronous line SL2 in series. The first flip-flop 24 makes a two frequency-division of a horizontal synchronizing signal Hsync applied to its clock terminal CLK over the second synchronous line SL2, and applies the two frequency-divided, horizontal synchronizing signal 2Hsync as shown in FIG. 11 to a multiplexor 32 and a first inverter 34. The first inverter 34 inverts the frequency-divided, horizontal synchronizing signal 2Hsync and applies the inverted horizontal synchronizing signal /2Hsync as shown in FIG. 11 to the multiplexor 32.

The second flip-flop 26 makes a two frequency-division of the two frequency-divided horizontal synchronizing signal Hsync applied from the first flip-flop 24 to its clock terminal CLK again to generate a four frequency-divided horizontal synchronizing signal 4Hsync as shown in FIG. 11. The four frequency-divided horizontal synchronizing signal 4Hsync generated at the second flip-flop 26 is applied to the multiplexor 32 and the second inverter 36. The second inverter 36 inverts the four frequency-divided horizontal synchronizing signal 4Hsync and applies the inverted horizontal synchronizing signal /4Hsync as shown in FIG. 11 to the multiplexor 32.

Likewise, the third flip-flop 28 makes a two frequency-division of the four frequency-divided horizontal synchronizing signal 4Hsync applied to its clock terminal CLK from the second flip-flop 26 again to generate an eight frequency-divided horizontal synchronizing signal 8Hsync as shown in FIG. 11. The 8 frequency-divided horizontal synchronizing signal 8Hsync generated at the third flip-flop 28 is applied to the multiplexor 34 and the inverter 38. The third inverter 38 inverts the 8 frequency-divided horizontal synchronous signal 8Hsync and applies the inverted horizontal synchronizing signal /8Hsync to the multiplexor 32.

The first to third flip-flops 24 to 28 are cleared in the vertical blanking period of a vertical synchronizing signal Vsync from the first synchronous line SL1 to their clear terminals CLR. The counter 30 is reset by means of a reset signal RCS applied from a reset line RCL to its clear terminal CLR. The reset signal RCS is generated when a power is initially supplied to a liquid crystal display device (not shown) including the liquid crystal panel 10, and the gate and data driving ICs 20 and 22. The counter 30 responds to the vertical synchronizing signal Vsync from the first synchronous line SL1 to count a certain number (for example, 0 to 6) repeatedly. The counted value from the counter 30 is supplied to the multiplexor 32. Then, the multiplexor 32 selects any one of six frequency-divided horizontal synchronizing signals 2Hsync, /2Hsync, 4Hsync, /4Hsync, 8Hsync and /8Hsync in accordance with the counted value from the counter 30, and applies the selected frequency-divided horizontal synchronizing signal commonly to the data driving ICs 22 as an inversion control signal ICS. As a result, the first to third flip-flops 24 to 28, the counter 30, the first to third inverters 34 to 38 and the multiplexor 32 act as inversion control means generating the inversion control signal ICS by making use of the horizontal synchronizing signal Hsync and the vertical synchronizing signal Vsync.

Each of the data driving ICs 22 receiving the inversion control signal ICS from the multiplexor 32 gradually increases the number of liquid crystal cells on the vertical axis (i.e., the data line), to which the same polarity of data signals are continuously applied in accordance with a logical state of the inversion control signal ICS, in every certain number (e.g., 6) of frame periods. The data driving ICs 22 allow the polarity of the data signals applied to the liquid crystal cells along the horizontal axis (i.e., the gate line) to be alternately inverted. As a result, with the aid of the inversion control signal ICS, the data driving ICs 22 periodically and repeatedly increase the number of liquid crystal cells on the vertical axis having the same polarity of data signals applied continuously every certain frame period. Accordingly, in the liquid crystal panel driving apparatus according to an embodiment of the present invention, even when a picture having a specific pattern, such as check pattern, subpixel pattern and windows shut-down mode pattern, etc., is displayed, such a phenomenon that the liquid crystal panel is driven in the frame inversion system does not appear, and a flick noise does not occur. As a result, the liquid crystal panel driving apparatus is capable of constantly maintaining the quality of a picture displayed on the liquid crystal panel independently of a pattern of picture.

As an alternative embodiment of the present invention, additional flip-flops may be used in series to generate increased frequency divided signals of the Hsync signal. The outputs of the additional flip-flops are then applied to the data driver ICs 22 to increase the number of liquid crystal cells added to each polarity block.

As described above, in the liquid crystal panel driving method and apparatus of cycle inversion system according to the present invention, the polarity of data signals applied to the liquid crystal cells on the vertical axis is alternately inverted and the polarity of data signals applied to the liquid crystal cells on the horizontal axis is alternately inverted. Also, in the liquid crystal panel driving method and apparatus of cycle inversion system according to the present invention, the number of liquid crystal cells on the vertical axis having the same polarity of video signal applied continuously increases periodically and repeatedly. Accordingly, in the liquid crystal panel driving method and apparatus of cycle inversion system according to the present invention, even when a picture having a specific pattern, such as check pattern, subpixel pattern and windows shut-down mode pattern, etc., is displayed on the liquid crystal panel, the phenomenon of driving the liquid crystal in the frame inversion system does not appear and also a cross talk between the row lines and between the column lines does not occur. As a result, a flicker noise is not generated independently of a pattern of picture so that a good quality of picture can be stably provided in the liquid crystal panel driven by the liquid crystal panel driving method and apparatus according to the present invention.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a liquid crystal panel having liquid crystal cells, the method comprising the steps of:

grouping the liquid crystal cells in the liquid crystal panel into a plurality of polarity blocks, each polarity block having at least one liquid crystal cell;

applying data signals having a first polarity to corresponding liquid crystal cells included in each polarity block;

applying data signals having a second polarity to adjacent polarity blocks to each polarity block; and gradually increasing the number of the liquid crystal cells included in the plurality of polarity blocks in every frame periods.

2. The method of claim 1, wherein the number of the liquid crystal cells included in each polarity block is increased for every first predetermined number of frame periods.

3. The method of claim 2, further comprising repeating the increase in the number of the liquid crystals included in each polarity block in every second predetermined number of frame periods.

4. The method of claim 1, wherein liquid crystal cells added to each one of the plurality of polarity blocks in each frame period expands in a vertical direction.

5. The method of claim 2, wherein the first predetermined number of frame period is set to two frames.

6. The method of claim 3, wherein the second predetermined number of frame period is set to six periods of frame interval.

7. A liquid crystal panel system performing the method of claim 1.

8. A liquid crystal panel driving apparatus, comprising:

means for dividing liquid crystal cells in a liquid crystal panel into a plurality of polarity blocks;

data driving means for applying the same polarity data signals to the liquid crystal cells included in each polarity block and for applying opposite polarity data signals to adjacent polarity blocks;

polarity block control means for gradually increasing the number of the liquid crystal cells included in each one of the plurality of polarity blocks in every first predetermined number of frame period; and cycle control means for repeating the increase in the number of the liquid crystals included in each one of the plurality of polarity blocks every second predetermined number of frame period.

9. The liquid crystal panel driving apparatus of claim 8, wherein the polarity block control means allows each of the plurality of polarity blocks to include a gradually larger number of liquid crystal cells adjacent in the vertical direction as the frame is progressed.

10. The liquid crystal panel driving apparatus of claim 8, wherein the polarity block control means increases the number of liquid crystal cells included in each polarity block every two periods of frame interval.

11. The liquid crystal panel driving apparatus of claim 8, wherein the cycle control means allows the second predetermined number of frame period to be set to six periods of frame interval.

12. A liquid crystal panel driving apparatus, comprising:

a liquid crystal panel having liquid crystal cells arranged in a substantially matrix form;

drivers arranged adjacent the liquid crystal cells to drive each one of the liquid crystal cells;

a frequency controller responsive to a first input signal and a first clock signal to output at least two polarity control signals; and a multiplexor connected to the frequency controller to selectively output one of at least two polarity control signals to the drivers to control polarity of liquid crystal cells.

13. The liquid crystal panel driving apparatus of claim 12, wherein the frequency controller includes:

a first frequency divider responsive to a first input signal and a first clock signal to provide a first output;

a second frequency divider responsive to the first output and the first clock signal to provide a second output; and a third frequency divider responsive to the second output and the first clock signal to provide a third output, wherein the first, second and third outputs are frequency divided signal of the first input signal.

14. The liquid crystal panel driving apparatus of claim 12, wherein the frequency controller includes a counter responsive to a first clock signal to output a count signal to control the multiplexor.

15. The liquid crystal panel driving apparatus of claim 14, wherein the multiplexor is responsive to the count signal from the counter to output one of the at least two polarity signals to the drivers.

16. The liquid crystal panel driving apparatus of claim 13, wherein the frequency controller includes a counter responsive to a first clock signal to output a count signal to control the multiplexor.

17. The liquid crystal panel driving apparatus of claim 16, wherein the multiplexor is responsive to the count signal from the counter to output one of the first, second and third outputs from the first, second and third frequency dividers, respectively, to the drivers.

18. The liquid crystal panel driving apparatus of claim 13, wherein the first, second and third frequency dividers are flip-flops.

19. The liquid crystal panel driving apparatus of claim 14, wherein the counter is of a modulo 4 type.

20. The liquid crystal panel driving apparatus of claim 12, wherein the first input signal is a horizontal sync signal and the first clock signal is a vertical sync signal.

21. A method of driving a liquid crystal panel having liquid crystal cells, the method comprising the steps of:

(a) grouping the liquid crystal cells in the liquid crystal panel into a plurality of polarity blocks, each polarity block having an initial number of liquid crystal cell;

(b) applying data signals having a first polarity to liquid crystal cells in a first polarity block during a first frame;

(c) applying data signals having a second polarity to liquid crystal cells in a second polarity block located adjacent the first polarity block during a second frame; and (d) incrementing a number of liquid crystal cells in the first and second polarity blocks by at least one liquid crystal cell.

22. The method of claim 21, further comprising the steps of:

repeating the steps of (b) to (d) in subsequent frames.

23. The method of claim 21, wherein the liquid crystal cells of the first and second polarity blocks are arranged in a first direction of the liquid crystal panel.

24. The method of claim 23, wherein the first direction constitutes a vertical direction of the liquid crystal panel.

25. The method of claim 21, wherein after repeating the steps of (b) to (d) for at least three times, the number of liquid crystal cells in the first and second polarity blocks are reset to the initial number of liquid crystal cell.

* * * * *